US006125502A

United States Patent [19]

Hammeken et al.

[11] Patent Number: 6,125,502

[45] Date of Patent: Oct. 3, 2000

[54] SUCTION PIPE FOR A SUCTION CLEANER

[75] Inventors: Nils Preben Hammeken, Holte, Denmark; Benny Matthiassen, Madison, Wis.

[73] Assignee: Nilfisk A/S, Brondby, Denmark

[21] Appl. No.: 09/051,424

[22] PCT Filed: Oct. 14, 1996

[86] PCT No.: PCT/DK96/00438

§ 371 Date: Aug. 20, 1998

§ 102(e) Date: Aug. 20, 1998

[87] PCT Pub. No.: WO97/13444

PCT Pub. Date: Apr. 17, 1997

[30] Foreign Application Priority Data

Oct. 12, 1995 [DK] Denmark ..... 1148/95

[51] Int. Cl.[7] ..... A47L 9/02; A47L 9/32

[52] U.S. Cl. ..... 15/411; 15/410; 15/415.1

[58] Field of Search ..... 15/411, 410, 415.1

[56] References Cited

U.S. PATENT DOCUMENTS

| | | | |
|---|---|---|---|
| 243,098 | 6/1881 | Becker et al. | 15/415.1 X |
| 847,947 | 3/1907 | Kenney | 15/410 X |
| 996,991 | 7/1911 | Little . | |
| 1,014,776 | 1/1912 | Rubel | 15/410 |
| 1,086,367 | 2/1914 | Hopoe | 15/411 X |
| 1,102,142 | 6/1914 | Cooley . | |
| 1,115,989 | 11/1914 | Thurman | 15/410 X |
| 1,161,908 | 11/1915 | Tice | 15/411 |
| 1,355,553 | 10/1920 | Goughnour | 15/411 |
| 2,038,697 | 4/1936 | Winslow . | |
| 2,056,850 | 10/1936 | Goughnour | 15/410 X |
| 5,109,568 | 5/1992 | Rohn et al. . | |

FOREIGN PATENT DOCUMENTS

| | | |
|---|---|---|
| 104383 | 4/1942 | Sweden . |
| 8403429 | 9/1984 | WIPO . |

*Primary Examiner*—Chris K. Moore
*Attorney, Agent, or Firm*—Ladas & Parry

[57] ABSTRACT

A suction pipe for a suction cleaner comprising an elongated pipe having at its lower end, in the in-use position, a coupling stud for a suction mouthpiece, and opposite this end, a flexible suction hose facing to one side relative to the elongated pipe, and wherein the suction pipe further has an upper operating handle arranged above the flexible suction hose in the in-use position. The upper operating handle in the in-use position of the suction pipe is arranged at a distance above the flexible suction hose that exceeds the length of the forearm of the operator, and the upper operating handle is so arranged that it allows it to be seized from that side of the suction pipe on which the flexible suction hose is arranged. This enables the operator to seize the upper operating handle with one hand and hold this upper operating handle at his own shoulder and to seize with his other hand further down on the suction pipe at the height of his hip whereby a completely new and ergonomically optimum work posture is obtained.

18 Claims, 4 Drawing Sheets

SUCTION PIPE FOR A SUCTION CLEANER

FIELD OF THE INVENTION

The present invention relates to a suction pipe for a suction cleaner of the type described in the introductory part of claim 3, wherein the suction pipe comprises an elongated pipe having at its lower end a coupling stud for coupling a suction mouthpiece thereto, and a second coupling stud for a flexible suction hose with a view to supplying vacuum to the suction pipe, and wherein the suction pipe is further provided with an upper operating handle at its uppermost end, said operating handle being arranged above the coupling stud for the flexible suction hose.

BACKGROUND

Suction pipes of this known type differ from conventional suction pipes for e.g. vacuum cleaning, wet-suction and carpet cleaning, in that the upper operating handle is arranged above the coupling stud for the flexible suction hose, as opposed to the most widely used conventional suction pipes which have an upper operating handle that encloses the coupling stud for the flexible suction hose and is thus integral therewith in one and the same unit.

The known suction pipes distinguish themselves over the conventional ones in that a higher degree of freedom is allowed to design the operating handle in the ergonomically most correct manner as regards handling surface and handling angle, etc. Even though the known suction pipes have thereby been improved compared to the conventional ones, both types of suction pipes require one and the same work posture during the cleaning as will be described in the following.

This work posture which is used for both said types of suction pipes for the cleaning of e.g. horizontal surfaces consists in that the operator seizes the upper operating handle in his one hand and holds this upper operating handle approximately at hip height and subsequently pushes and pulls the mouthpiece mounted on the suction pipe forwards and backwards in front of him or sideways. The separate suction unit which is connected to the suction pipe via the flexible suction hose is pulled along by the operator who then exerts a more powerful pull in the flexible suction hose.

In order to be able to transmit these pushing and pulling movements to the suction pipe and thus to the mouth piece, the operating handle on the known suction pipes are oriented at an angle relative to the longitudinal axis of the suction pipe of between 30° and 60° whereby the longitudinal axis of the operating handle is caused to be substantially parallel with the supporting surface being cleaned. Moreover, the operating handle is arranged at a distance from and sideways relative to the longitudinal axis of the suction pipe whereby the operating handle is caused to face to the same side as the coupling stud for the flexible suction hose. Thereby the operator may transmit a moment to rotate the suction pipe about its longitudinal axis by means of the operating handle with a view to manoeuvring the mouthpiece and establishing such pull in the suction pipe which is required to move the separate suction unit.

However, while occupying this work posture, it is difficult for the operator to shift the mouthpiece sideways relative to the longitudinal axis of the suction pipe with only one hand and relative to the operator himself which means that the operator is often forced to seize the suction pipe with his other hand further down on the pipe in order to apply more force for moving the suction pipe, whereby the operator is caused to occupy an inconvenient, hunched work posture.

SUMMARY OF THE INVENTION

In the light of this it is the object of the present invention to provide a suction pipe of the type described above which enables an ergonomically correct work posture for the cleaning of e.g. horizontal surfaces while also enabling the operator to use both hands for guiding the suction pipe whereby the operator may easily shift and orient the mouthpiece in all directions relative to his own position.

Thereby the operator may hold the upper operating handle at shoulder height and seize the suction pipe further down with his other hand. The entire suction pipe being in this manner relatively close to the operator, he does not have to bend over to use both hands for controlling the suction pipe. At the same time the operator may, during use, operate the suction pipe by seizing the upper operating handle with his one hand and seizing the lower operating handle with the other hand, and then hold the suction pipe in such a manner that his first-mentioned hand is kept approximately at shoulder height and his second hand approximately at hip-height. In this starting position the operator may swing the suction pipe from side to side in front of him. The fact that the mouthpiece is so oriented that the suction slot is approximately perpendicular to the orientation of the curve movement means that effective and swift sweeping of the supporting surface to be cleaned is obtained while simultaneously eliminating the need for the operator to occupy a hunched posture which is ergonomically incorrect.

Hereby the operator is allowed to work with the suction pipe relatively close to his body which facilitates his work significantly since the back of the operator will be influenced only by relatively small moments of force. Moreover the actual effort which may be exerted by the operator on the suction pipe is substantially increased compared to the situation when the pipe is kept at a distance from the body.

Practice has shown that in most cases this is obtained provided the distance between the operating handle and the flexible suction hose exceeds 25 cm, and is preferably longer than 30 cm.

According to a particularly advantageous embodiment, the upper operating handle is so arranged relative to the suction pipe that the longitudinal axis of the suction pipe extends through the operating handle. This makes it easy for the operator to turn the elongated pipe about its longitudinal axes with the hand that seizes the pipe further down without straining the wrist of his other hand significantly.

By providing the upper operating handle to be substantially identical on both that side of the upper operating hand which faces the same way as the flexible suction hose and on the opposite side, it is obtained that it is easy to use the suction cleaner for forward as well as backward cleaning by pulling the suction unit which is connected to the suction pipe via the suction hose, whether the suction hose is in front of or behind the operator. This effect is obtained because the coupling stud to the suction hose may be oriented relatively freely relative to the operator and relative to the longitudinal axis of the suction pipe without the positioning of the upper operating handle relative to the longitudinal axis of the suction pipe being changed significantly.

The operating handle may be elongated and oriented perpendicular to the longitudinal axis of the elongated pipe, but particularly advantageously it may have such orientation that the longitudinal axis of the operating handle is substantially parallel with the longitudinal axis of the suction pipe, as defined in claim 8. Hereby the operator is capable of seizing the pipe from any side without entailing any change in the way the pipe is experienced during use.

According to a particularly advantageous embodiment, the upper operating handle consists of an rod-shaped element secured to the elongated pipe and extending substantially as an extension of the elongated pipe. Hereby the rod-shaped element may be seized at any height in accordance with the height of the operator whereby the suction pipe is easy to use for operators of different heights without ensuing adjustments in the suction pipe height.

The operator has to seize further down on the suction pipe in order to operate the suction pipe efficiently and this may be done by the operator seizing the suction pipe proper. According to a preferred embodiment an actual operating handle is arranged on the suction pipe for this purpose which makes it easier for the operator to use this lower operating handle to rotate the suction pipe about its own longitudinal axis.

The advantage of this lower operating handle is further enhanced if the operating handle protrudes outwards from the suction pipe proper. This means that the operating handle may be made to be ergonomically correct and that the operator is capable of rotating the suction pipe about its own axis more easily.

By orienting the lower operating handle substantially perpendicular to the longitudinal axis, good and ergonomic control and operation of the suction pipe may be obtained during use, since in that case the lower operating handle may easily be turned in the operator's hand without his wrist being moved. Thereby large curved movements may be performed with the suction pipe without imposing substantial strains on the operator's hand at the lower operating handle.

The suction pipe may be moved in curves from side to side relative to the operator. In practice, these curved movements may most often have the character of the upper operating handle being moved in one direction while the lower operating handle is simultaneously moved in the opposite direction. In this connection, by arranging the lower operating handle below the coupling stud for the flexible suction hose, it is obtained that the flexible suction hose may only be moved relatively little from side to side during use of the suction pipe.

Claim 12 features a particular embodiment wherein a high degree of freedom of movement of the suction pipe is obtained as well as freedom to orient the suction pipe and thus the mouthpiece with a view to carrying out various cleaning tasks in a flexible manner in places which are difficult to access. In particular, claim 13 features that the flexible joint may consist of a cardan or a homokinetic joint.

By securing the flexible joint relatively permanently to the suction pipe and releasably to the mouthpiece as featured in claim 14, the option becomes available of changing the mouthpiece in accordance with the cleaning task while simultaneously reusing the flexible joint when using the various mouthpieces.

BRIEF DESCRIPTION OF THE DRAWINGS

Preferred embodiments will be described in detail in the following with reference to the drawings, wherein.

DETAILED DESCRIPTION

Figure 1:
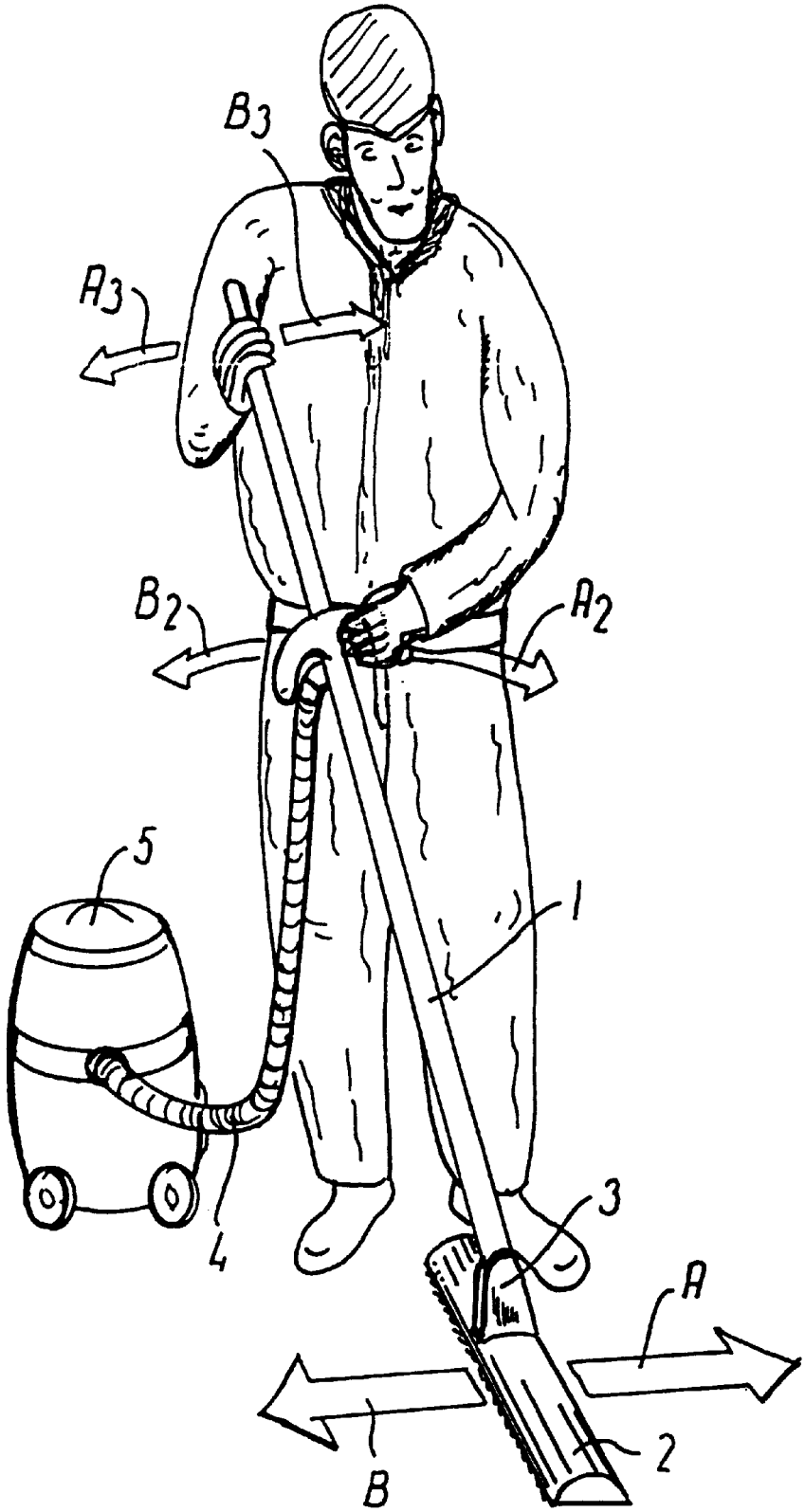
FIG. 1 shows an operator with a suction pipe according to the invention.

Thus, FIG. 1 illustrates an operator with a suction pipe 1 according to the invention. At its lower end, the suction pipe 1 is provided with a mouthpiece 2 via a joint connection 3 as will be described below. Via a flexible suction hose 4 the suction pipe 1 is connected to a suction unit 5 in a conventional manner. According to the invention the suction pipe is moved, as illustrated in the Figure, in such a manner that provided it is desired to move the mouthpiece 2 in the direction of the arrow A, the operator will use his one arm to influence the lower operating handle on the suction pipe in the direction of the arrow A2 and his other arm to influence the upper handle in the direction of the arrow A3. Provided it is desired to move the mouthpiece 2 in the direction of the arrow B, the operator influences the operating handles inversely in the directions of the arrows B2 and B3. In this manner the invention allows the supporting surface to be swept by the suction mouthpiece 2 by the operator holding his one hand at about shoulder height and his other hand at about hip height. Since the operator holds both hands relatively close to his body, the operator is capable of influencing the suction pipe 1 with relatively much force whereby this sideways movement is relatively easy to carry out for the operator. In addition, the spine of the operator is not significantly influenced by moments, since the moments of force with which the operator should influence the suction pipe 1 are, as indicated by the arrows, always oppositely oriented.

Ergonomically this work posture, which is illustrated in FIG. 1, is optimum since the operator is capable of using relatively much force to move the suction pipe 1 without having to occupy a hunched position while simultaneously substantially avoiding twisting of the operator's spine.

Figure 4:
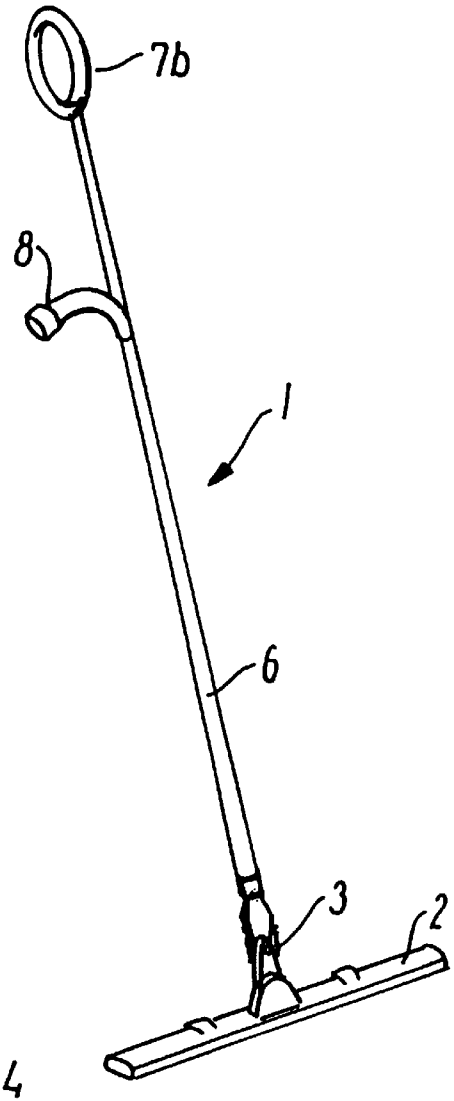
FIGS. 3 and 4 are perspective views of alternative embodiments of the suction pipe according to the invention.
Figure 3:
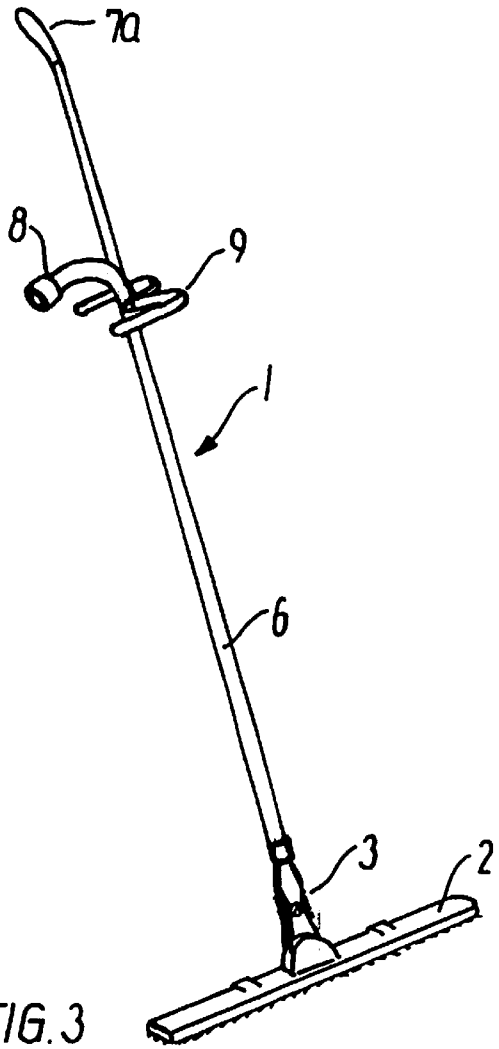
Figure 2:
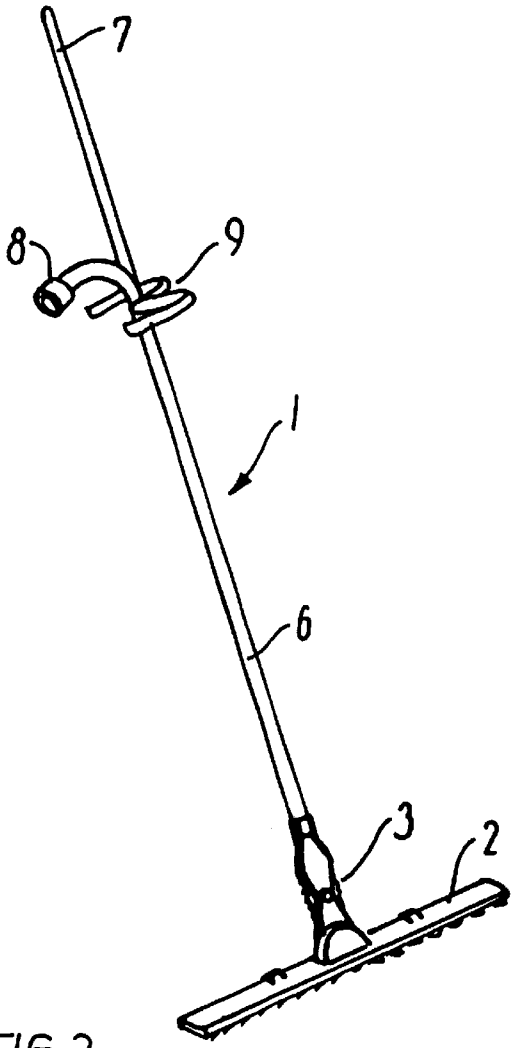
FIG. 2 is a perspective view of the suction pipe according to FIG. 1.

Now, FIGS. 2, 3 and 4 illustrate three different embodiments of a suction pipe 1 according to the invention, where in particular FIG. 2 illustrates the embodiment also shown in FIG. 1. Thus the suction pipes 1 are provided with mouthpieces 2 via joint connections 3 which will be described below. The joint connection 3 is secured releasably or permanently to a rigid suction pipe 6 which, in a conventional manner, extends upwards to a coupling point 8 for a flexible suction hose. The flexible suction hose is not shown in the Figures, but may either be coupled permanently to the coupling 8 or be releasably connected therewith. Above the coupling 8 and in accordance with the invention, operating handles 7,*7a*,*7b* are provided in such a manner that the suction pipe 1 may be moved in the manner shown in FIG. 1. In FIG. 2 the operating handle 7 is made with the particular shape of a straight rod which extends upwards as an extension of the rigid pipe 6, whereby an operating handle is provided. The operating handle 7 being provided as a straight rod which may optionally be telescopic or interchangeable, the operating handle may be seized at any height thereby eliminating the need for the suction pipe to be provided with particular adaptation means for adapting its height to the height of a given operator. Moreover the operator may seize the operating handle 7 from above at the end of the operating handle 7 since this end may be in the form of a knob.

FIG. 3 illustrates an alternative embodiment where the upper handle 7*a* is at a small angle relative to the rigid pipe 6. The embodiments shown in FIGS. 2 and 3 have in common that further down on the suction pipe 1 they are provided with protruding operating handles 9 whereby it is easy for the operator to rotate the suction pipe 1 about its longitudinal axis by means of these protruding operating handles, whereby the mouthpiece 2 may be rotated in the plane of the supporting surface via the joint connection 3. The upper operating handles 7 and 7*a* being arranged substantially as an extension of the longitudinal axis of the suction pipe 1, the strain on the wrist of the operator is relieved during such rotation.

Herein the protruding operating handles 9 may advantageously be so designed that they may be displaced upwards or downwards on the rigid pipe 6, or the rigid pipe may be adjustable in length. Thereby the height of the lower operating handle 9 may be adjusted to the height of the operator.

FIG. 4 illustrates an alternative suction pipe having at the top an operating handle 7*b* which is substantially perpendicular to the longitudinal axis of the suction pipe 1 whereby this operating handle 7*b* is suitable for rotating the suction pipe 1 about its own longitudinal axis. Thus, in this embodiment the need for protruding operating handles further down on the suction pipe 1 has been eliminated, as will appear from FIG. 4.

It follows that according to the invention it is possible to provide the upper and lower operating handles in many different embodiments and in many different combinations in addition to the wide ones which allow a work procedure as described in connection with FIG. 1.

Figure 5:
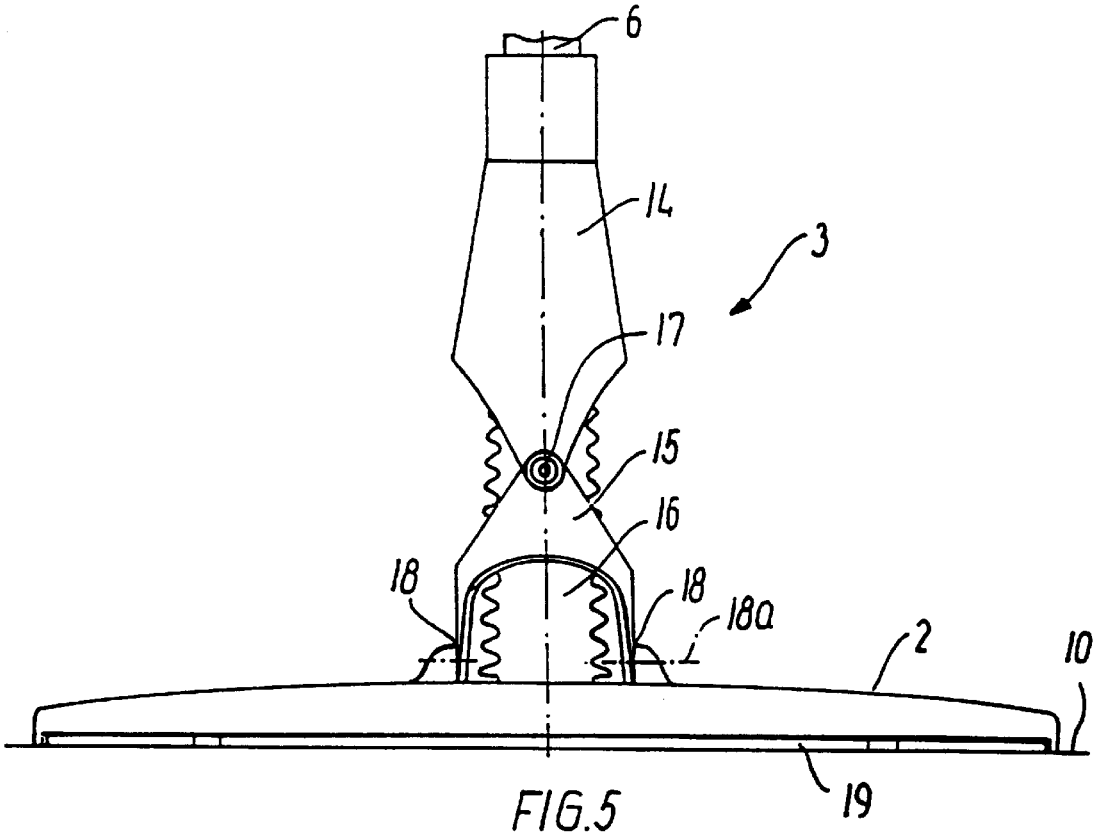
FIG. 5 is a detailed front view of the suction mouthpiece on the suction pipe according to FIG. 2.

Reference is now made to FIG. 5 which illustrates a vacuum cleaner mouthpiece which comprises, in a conventional manner, a housing 2 that distributes vacuum from the suction pipe 6 (not shown in its entirety but only outlined) of a vacuum cleaner to a suction sole 19 arranged for sweeping a plane 10, such as a floor or the like surface. According to the invention the mouthpiece could also constitute another type of mouthpiece, such as a wet-suction mouth piece.

According to the invention the housing 2 is provided with joint connections 18 for receiving an intermediate joint 15 which is, in turn, via a joint connection 17 secured to a further joint 14, which is, in turn, secured to the suction pipe 6 of the vacuum cleaner.

Hereby the joint connections 17 and 18 form, in principle, a Cardan joint wherein, however, the axes 17*a* and 18*a* are not in the same plane as is the case with conventional Cardan joints.

Figure 6:
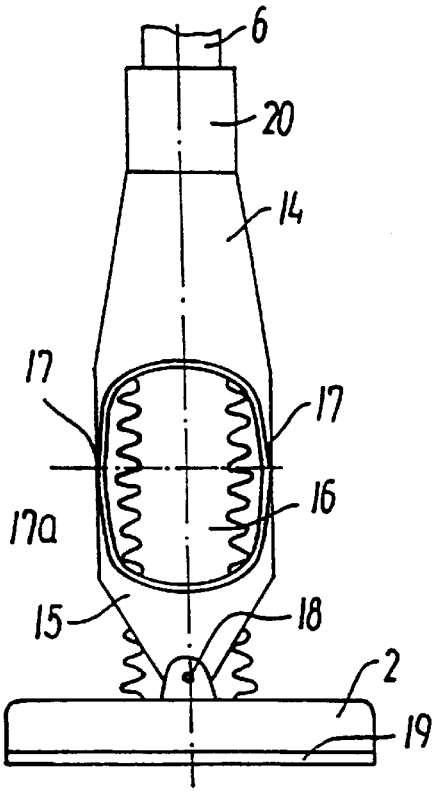
FIG. 6 is a side view of the suction mouthpiece according to FIG. 5.

FIG. 6 illustrates the same vacuum cleaner mouthpiece seen from the side to show that the two joints 14 and 15 are substantially tubular, and that the joint connections 17 and 18 of the joints 15,16 are arranged perpendicular to each other and perpendicular to the plane 20 which is perpendicular to the abutment surface 10 of the suction sole and extends along with and through the elongated suction slot in the suction sole 19.

The combination of FIGS. 5 and 6 further illustrates that the two joints 14 and 15 are substantially tubular, and that a hose 16 made of a flexible material, e.g. a rubber bellows in the embodiment shown, extends centrally downwards through the two joints 14 and 15.

The hose 16 is so designed that it is capable of transmitting a vacuum from the suction pipe 6 of the vacuum cleaner to the suction sole 19 on the vacuum cleaner mouth piece 2. The securing and the design of the hose 16 being obvious to the skilled person and not of specific interest to the mode of operation of the present invention, they are not described in detail herein, nor is it shown how the suction passages for the vacuum cleaner mouthpiece 2 are arranged in the housing and in the suction sole 19. However, in a conventional manner the suction sole 19 is provided with one or more suction passages or suction slots which extend substantially in the longitudinal direction of the housing.

The Cardan joint formed by the joints 14 and 15 and the joint connections 17 and 18 being provided with axes which are perpendicular to each other, and the Cardan joint as such being of symmetrical construction, a freedom of movement is thus obtained between the housing on the vacuum cleaner mouthpiece 2 and the suction pipe 6 of the vacuum cleaner which is largely symmetrical. Moreover, this means that during use, when the suction sole 19 sweeps a surface, a rotation of the housing with the suction sole 19 is obtained which substantially corresponds to a given rotation of the suction pipe of the vacuum cleaner. Moreover, this rotation may perform a full circle since the Cardan joint formed by the joints 14 and 15 as well as the joint connections 17 and 18 do not inhibit such rotation.

Hereby in particular the hinge connection 18 provides the possibility of mutual rotation of the suction pipe 6 of the vacuum cleaner and the joints 14 and 15 outwards to both sides of the plane 11 shown which extends along the suction sole 19. Hereby a work movement is allowed where the vacuum cleaner mouthpiece 1 may be displaced from side to side relative to the user instead of away from and towards the user as is known with conventional mouthpieces. In practice, this work posture has proved to result in a quicker and more efficient working method in the vacuum cleaning of e.g. floors while simultaneously enabling a more varied and ergonomically convenient work posture as is described in connection with FIG. 1.

The latter effect may also be obtained with other types of joints for connecting the housing of the vacuum cleaner mouthpiece to the suction pipe 6 of the vacuum cleaner without the idea of the invention being lost. Thus, a conventional joint for vacuum cleaner mouthpieces may be used provided the joint connection is pivoted 90° relative to their orientation on the known mouthpieces.

Additionally, e.g. a so-called homokinetic joint may be used which may e.g. consist of a ball joint with a ball dish and a ball sliding therein wherein a pin and tongue connection is further established between the ball dish and the ball for transmitting an angular rotation therebetween. In principle, it will hereby be obvious to the person skilled in the art that any torsionally rigid connecting element which permits angular rotation between the portions connected by the connecting element may be used for this purpose.

In the embodiment shown in FIGS. 5 and 6 the suction pipe 6 of the vacuum cleaner and the joints 14 and 15 as well as the housing 2 are permanently connected to each other whereby this embodiment aims specifically at professional cleaning of e.g. large walking areas and the like. In such situations cost-increasing, releasable connections may be avoided since these are not necessary for this use. Provided, however, the suction cleaner mouth piece is intended for use in other contexts, it is obvious to the skilled person to establish releasable connections between e.g. the suction pipe 6 of the vacuum cleaner and the joint 14 or between the housing 2 and the joint 15.

Figure 7:
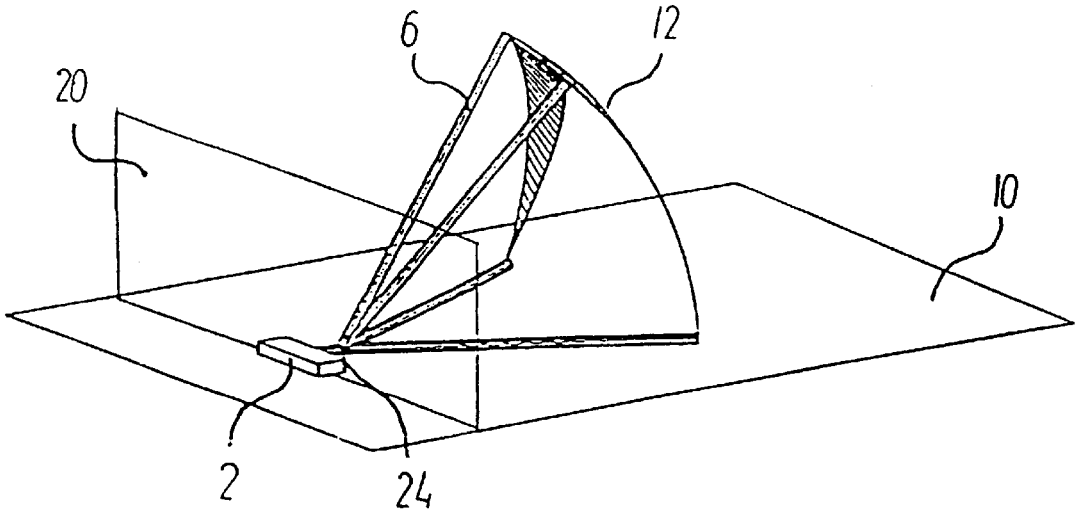
FIG. 7 PRIOR ART
FIG. 7 outlines the movement in space of a suction pipe of known type for vacuum cleaners.
Figure 8:
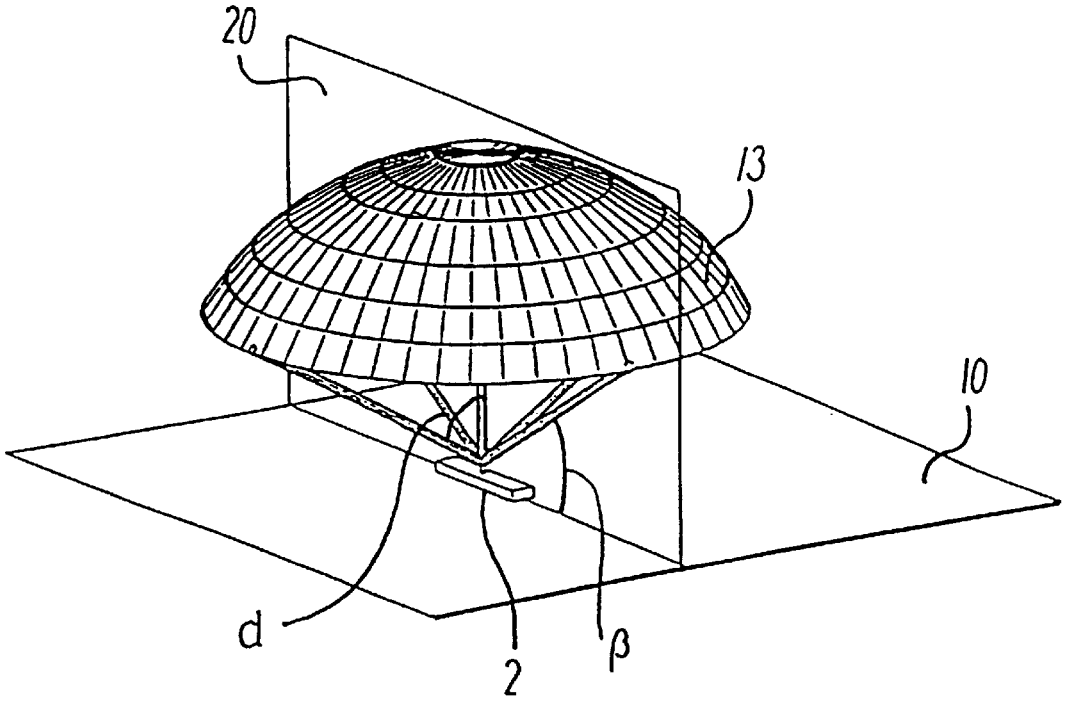
FIG. 8 outlines the movement in space of a suction pipe as shown in FIGS. 2 through 4.

Now, for comparison FIGS. 7 and 8 illustrate the operating range 12 which may be obtained with suction pipes of conventional type for vacuum cleaners seen in relation to the operating range 13 for a joint mechanism according to FIGS. 5 and 6. Thus, FIG. 7 illustrates the operating range 12 for a joint mechanism 24 of conventional type where FIG. 7 is intended to show how the mouthpiece 2 is secured in the plane 10 and the outlined area 12 illustrates the operating range available to the suction pipe 6 of the vacuum cleaner.

As will appear from FIG. 7, the joint mechanism 14 allows only that suction pipe 7 may be used on a side of the vertical plane 20 which extends along the not shown suction slot in the mouthpiece 2.

For comparison, FIG. 8 illustrates that the operating range 13 for a joint mechanism of the type shown in FIGS. 5 and 6 is far more comprehensive and may in particular extend to both sides of the vertical plane 20 which extends along with the not shown suction slot in the mouthpiece 2. Thus, the suction pipe 6 may assume different angles $\alpha$ and $\beta$ as indicated in the Figure and the angle $\alpha$ may thus assume positive as well as negative values since the suction pipe 6 according to the invention may move to both sides of the vertical lane 20.

According to the invention the angle $\beta$ may be a permanent angle which is preferably less than 80° relative to the plane 10 in order to obtain an ergonomically correct posture of use. According to a convenient embodiment, however, the angle $\beta$ may assume several different angles whereby the in-use situation is further improved. Thus FIG. 8 illustrates that the angle $\beta$ may assume all angles between 45 and 135° which means that an incredibly large freedom of movement for the mouthpiece relative to the suction pipe 6 is obtained.

Obviously the embodiments illustrated serve merely as preferred embodiments, and a person skilled in the art is, in the light of this description, able to point out other embodiments based on the idea behind the invention. Thus, the rigid pipe 6 may have various shapes and extend more or less rectilinearly between the suction mouthpiece 2 and the operating handles 7,7*a*,7*b* and 9. Moreover the operating handles many be varied in may different ways as regards their orientation relative to the suction pipe as well as their position relative thereto.

What is claimed is:

1. A suction pipe assembly for a vacuum cleaner comprising:

an elongated suction pipe having a longitudinal axis, said suction pipe having first and second opposite ends, a joint at said first end for connection of a suction mouthpiece thereat, said suction mouthpiece having a suction sole with a planar abutment surface for traveling on a surface to be cleaned, said suction mouthpiece having an elongated suction slot which is open at said abutment surface, said mouthpiece defining a plane of reference perpendicular to said abutment surface and extending along and through said suction slot, a coupling at said second end of said suction pipe for connection with a flexible suction hose, said coupling extending laterally from said suction pipe at one side thereof, an upper operating handle arranged at a distance from said coupling in a direction away from said suction pipe for being engaged by a user from said one side, said joint comprising a flexible connection for transmitting rotation of said suction pipe about said longitudinal axis thereof to said mouthpiece to produce rotation of the mouthpiece freely in the plane of said abutment surface, said flexible connection permits relative pivoting of said suction pipe with respect to said mouthpiece about an axis parallel to said elongated suction slot for movement on both sides of said reference plane.

2. A suction pipe assembly according to claim 1, wherein said flexible connection further permits movement of said suction pipe in said reference plane about an axis perpendicular to said reference plane.

3. A suction pipe assembly according to claim 2, wherein said upper operating handle is so arranged relative to the suction pipe that said longitudinal axis of said suction pipe extends through at least a portion of said upper operating handle.

4. A suction pipe assembly according to claim 3, wherein said operating handle comprises a first portion facing towards said first side and a second portion facing towards a second side of the suction pipe opposite said first side.

5. A suction pipe assembly according to claim 4, wherein said first and second portions of the upper operating handle are elongated and extend substantially perpendicular to the longitudinal axis of the suction pipe.

6. A suction pipe assembly according to claim 4, wherein the upper operating handle is elongated and is so oriented relative to said longitudinal axis of the suction pipe that a longitudinal axis of the upper operating handle is substantially parallel with said longitudinal axis of the suction pipe.

7. A suction pipe assembly according to claim 1, wherein said distance between the upper operating handle and said coupling is at least 25 cm.

8. A suction pipe assembly according to claim 1, wherein the upper operating handle comprises a rod-shaped element secured to the elongated suction pipe and extending substantially in extension thereof.

9. A suction pipe assembly according to claim 1, wherein the suction pipe further includes a lower operating handle secured to said suction pipe in a location closer to said first end of the suction pipe than the upper operating handle.

10. A suction pipe assembly according to claim 9, wherein the lower operating handle protrudes from the suction pipe.

11. A suction pipe assembly according to claim 10, wherein the lower operating handle includes a portion connection to said suction pipe substantially perpendicular to said longitudinal axis of the suction pipe.

12. A suction pipe assembly according to claim 9, wherein the lower operating handle is located closer to said first end of the suction pipe than said coupling.

13. A suction pipe assembly according to claim 1, wherein said flexible connection is constructed so that a given rotation of said suction pipe about its longitudinal axis produces an angular rotation of the mouthpiece in said plane of the abutment surface of substantially the same magnitude.

14. A suction pipe assembly according to claim 13, wherein said flexible joint consists of a homokinetic joint or a Cardan joint.

15. A suction pipe assembly according to claim 1, wherein the flexible joint is permanently connected to said suction pipe and releasably connected to said mouthpiece.

16. A suction pipe assembly according to claim 1, wherein the distance between the upper operating handle and said coupling is adjustable.

17. A suction pipe assembly according to claim 1, wherein said longitudinal axis of the suction pipe is arrangable in said plane of reference at angle of less than 80 degrees relative to said plane of the abutment surface.

18. A suction pipe assembly according to claim 1, wherein said flexible connection permits said mouthpiece to be oriented in a longitudinal direction of travel while permitting said pivoting of said suction pipe to enable the mouthpiece to be swept transversely of said direction of travel while being oriented in said longitudinal direction.

* * * * *